US012544828B2

(12) United States Patent
Priesol

(10) Patent No.: US 12,544,828 B2
(45) Date of Patent: Feb. 10, 2026

(54) METHOD OF MOLTEN METAL CASTING UTILIZING AN IMPACT PAD IN THE TUNDISH

(71) Applicant: I.P.C. REFRACTORIES, spol. s r.o., Kosice (SK)

(72) Inventor: Ivan Priesol, Kosice (SK)

(73) Assignee: I.P.C. REFRACTORIES, SPOL, S.R.O. (SK)

( * ) Notice: Subject to any disclaimer, the term of this patent is extended or adjusted under 35 U.S.C. 154(b) by 557 days.

(21) Appl. No.: 17/365,627

(22) Filed: Jul. 1, 2021

(65) Prior Publication Data

US 2021/0323055 A1 Oct. 21, 2021

Related U.S. Application Data

(63) Continuation of application No. 16/340,962, filed as application No. PCT/IB2016/056207 on Oct. 17, 2016, now abandoned.

(30) Foreign Application Priority Data

Oct. 10, 2016 (SK) ..... 89-2016

(51) Int. Cl.
*B22D 41/00* (2006.01)
*B22D 11/00* (2006.01)
(Continued)

(52) U.S. Cl.
CPC ..... *B22D 41/003* (2013.01); *B22D 11/00* (2013.01); *B22D 37/00* (2013.01); *B22D 41/00* (2013.01); *B22D 41/50* (2013.01)

(58) Field of Classification Search
CPC ..... B22D 41/003; B22D 11/00; B22D 37/00; B22D 41/00; B22D 11/181
(Continued)

(56) References Cited

U.S. PATENT DOCUMENTS 3,941,281 A * 3/1976 Hind ..... B22D 11/183 222/63
3,946,795 A 3/1976 Bruderer et al.
(Continued)

FOREIGN PATENT DOCUMENTS

CN 1135193 11/1996
CN 1178488 4/1998
(Continued)

OTHER PUBLICATIONS

The Geometric Modification of Impact Point In Tundish; Technical University of Kosice, Faculty of Metallurgy and Faculty of Aeronautics; IPC Refractories, s.r.o.; METALS, 2018, 8, x, at www.mdpi.com/journal/metals; pp. 1-10, Sep. 2018.
(Continued)

*Primary Examiner* — Keith D. Hendricks
*Assistant Examiner* — Michael Aboagye
(74) *Attorney, Agent, or Firm* — Woodard, Emhardt, Henry, Reeves & Wagner, LLP; Steve Zlatos

(57) ABSTRACT

A method of molten metal continuous casting utilizing an impact pad having a non-wavy spherical top in the tundish that is impacted by the stream of molten metal entering into the tundish wherein the flow of molten metal within the tundish is optimized to improve flow patterns, reduce dead zone areas, prevent splashing while filling the empty tundish, and eliminating the open "red" eye forming in the molten metal surface layer.

2 Claims, 1 Drawing Sheet

(51) Int. Cl.
*B22D 37/00* (2006.01)
*B22D 41/50* (2006.01)

(58) Field of Classification Search
USPC ..... 222/590, 591, 594; 266/44, 236, 275; 164/437, 337, 451, 459, 473
See application file for complete search history.

(56) References Cited

U.S. PATENT DOCUMENTS

| | | | | |
|---|---|---|---|---|
| 4,042,229 | A | 8/1977 | Eccleston | |
| 4,177,855 | A * | 12/1979 | Duchateau | B22D 41/00 266/275 |
| 4,573,664 | A | 3/1986 | Pendergast | |
| 4,600,047 | A | 7/1986 | Matoba et al. | |
| 5,188,796 | A | 2/1993 | Soofi | |
| 5,358,551 | A | 10/1994 | Saylor | |
| 5,868,955 | A | 2/1999 | Tavemier | |
| 6,516,870 | B1 * | 2/2003 | Chakraborty | B22D 11/111 75/305 |
| 6,554,167 | B1 | 4/2003 | Barrett | |
| 6,598,662 | B2 | 7/2003 | Kato et al. | |
| 7,789,123 | B2 * | 9/2010 | Hohenbichler | B22D 11/183 164/453 |
| 8,383,032 | B2 | 2/2013 | Drambarean | |
| 9,168,586 | B2 * | 10/2015 | Nitzl | B22D 41/186 |
| 2013/0233899 | A1 | 9/2013 | Kendall | |

FOREIGN PATENT DOCUMENTS

| | | | | |
|---|---|---|---|---|
| CN | 1341047 | | 3/2002 | |
| CN | 2578013 | | 10/2003 | |
| CN | 1511070 | | 7/2004 | |
| CN | 103608470 | | 2/2014 | |
| CN | 104955592 | | 9/2015 | |
| EP | 0184634 | * | 6/1986 | B22D 41/003 |
| SK | 288043 | | 2/2013 | |
| SK | 8474 | | 6/2019 | |
| WO | WO 99/37423 | | 7/1999 | |
| ZA | 9900359 | | 7/1999 | |
| ZA | 200108989 | | 6/2002 | |

OTHER PUBLICATIONS

IPS Spheric System for Steel Ladle and Tundish; submitted to EPO Dec. 4, 2020 in International Patent Application PCT/IB2016/056207; Utility Model: PUV108-2016; Patent Application: PP89-2016.

Tundish Technology for Clean Steel Production. Singapore: World Scientific Publishing Co. Pte. Ltd., 2008, pp. 173-237.

* cited by examiner

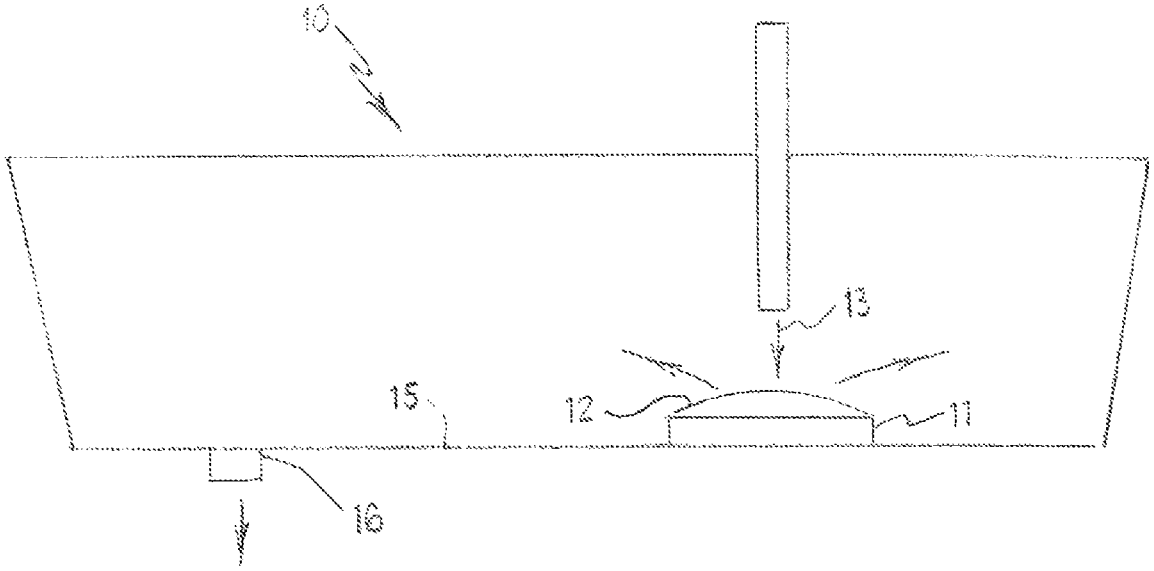
10
13
15
12
11
16

METHOD OF MOLTEN METAL CASTING UTILIZING AN IMPACT PAD IN THE TUNDISH

CROSS-REFERENCE TO RELATED APPLICATION

This application a continuation of U.S. Ser. No. 16/340,962 filed Apr. 19, 2019, and is the National Stage of International Application No. PCT/IB2016/056207, filed Oct. 17, 2016, which claims the benefit of Slovakia Application No. 89-2016, filed Oct. 10, 2016, the entire disclosures of which are hereby incorporated by reference.

BACKGROUND

The present invention relates to a method of molten metal continuous casting utilizing an impact pad having a spherical top in a tundish.

A tundish is typically a weldment of steel plates with reinforcing ribs and is provided with a refractory lining. In the bottom of the tundish there are refractory lined outlet nozzles. Tundish operations can affect the quality of the molten metal just before casting, so the development of tundish metallurgy is very important.

The tundish serves various metallurgical functions, such as a reservoir of liquid molten metal before casting and it is the transporter of molten metal or steel for individual casting streams during changing of the ladle. In addition, it minimizes casting flow splash, reduces ferrostatic pressure of the molten metal, homogenizes molten metal chemically and thermally, separates the liquid metal from slag, evens the casting speeds, allows for monitoring the temperature of the molten metal, uniforms the speed of casting, maintains a steady constant flow of molten metal, and maintains a constant liquid metal level in the crystallizer. In the tundish the non-metallic inclusions are decanted, and it is possible to apply the most recent metallurgical operations like doping for example. In the tundish there exists the ability for adjusting the retention time, also dead volume, etc. by controlling the liquid flow. Currently, there also exists as a major objective the use of the tundish as a tool for minimizing transitional areas and dead volumes.

The final quality of the steel depends on producing as little as possible slag entrainment and maximal depletion of non-metallic inclusions. Therefore, it is highly desirable to achieve optimal flow in the tundish. The flow of molten metal through the tundish has a hydrodynamic character, which includes single-phase turbulent flow and multiphase flow. As the retention time is differentiated, the amount of inclusions increases depending upon their motion, thermal energy is transferred and a swirl is generated at the beginning and end of the casting process. In order to achieve an optimal casting flow and thus a higher purity of metal, it is important to ensure: higher average retention time, reduction of strong turbulence and dead zones, coagulation acceleration in turbulent zones and floating inclusions by active cover slag, and elimination of open "red" eye forming a hole on the surface of the molten metal which causes the absorption of air in the molten metal. The residual metal and slag which remains in the tundish should be mechanically removed before the next casting, otherwise the slag is recycling. However, its removal is laborious and prolongs the cycle time of continuous casting. Another problem is the so-called dead volume, which lead to heat loss and conflux formation next to the tundish nozzles causing their sticking.

As a result, flow in the tundish must be guided by optimal control of the current directions and thermal gradients.

Heretofore, many sorts of devices and methods have been employed to optimize the flow of molten metal into and through the tundish including various kinds of dampers, dams, weirs, and impact pads. Each has exhibited drawbacks or otherwise do not fully address the problems and concerns discussed above.

One simple style of impact pad designed to protect the bottom surface of a tundish from eroding due to direct contact with the stream of molten metal entering the tundish is shown in FIG. 1 of Slovak patent No. SK288043. The impact pad 2 is mounted to the bottom 16 of the tundish 1 at a location directly below the incoming stream 3 of molten metal. The impact pad 2 is formed of a refractory material to withstand erosion from the molten metal stream and has a flat shaped top surface 7 that deflects the stream away from the bottom 16 of the tundish. One major disadvantage of this type of impact pad is that it causes an undesirable amount of turbulence in the liquid metal flow within the tundish.

U.S. Pat. No. 5,358,551 to Saylor discloses a turbulence inhibiting impact pad having a cavity at the top, which communicates the incoming molten stream to a flat planar impact surface located within the cavity. Turbulence is to some extent inhibited by annular sidewalls provided within the cavity to aid in smoothing the liquid flow. Unfortunately, the flat impact surface within the cavity still produces some abrupt flow reversal and all flow into the cavity must exit through the top.

Previously mentioned Slovak patent No. SK288043 also discloses cavity type impact pads including wherein the impact pad is provided with a plurality of side openings that act like weirs or canals to direct a component of the flow of molten metal horizontally or laterally within the tundish. Although the side openings provide a path for lateral flow of the molten metal, flow dead zones are created in the upper corners of the tundish.

U.S. Pat. No. 5,188,796 to Soofi discloses impact pads with or without a cavity, but which have a wavy shaped impact surface resembling a washboard. The waves are described as being either sinusoidal, triangular, or irregular, the only limitation being that the waves must be configured to significantly reduce the horizontal flat areas present in the upper surface of the impact pad. In one embodiment shown in FIG. 5(*b*), the wavy surface is described by sine waves in the surface along both the x-axis and the z-axis. Unfortunately, while the wavy impact surface reduces the horizontal flat areas present in the upper surface of the impact pad, there remains a need for more optimal flow control.

SUMMARY

The present disclosure pertains to a continuous method of molten metal casting utilizing an impact pad in the tundish that eliminates or significantly limits the disadvantages noted above. In at least one aspect, a stream of molten metal flows downwardly into the tundish, at the bottom of which is located an impact pad with a non-wavy spherical top that deflects the initial impact of the stream of molten metal discharged from the ladle, upon impacting the spherical top the flow of molten metal is accelerated and optimized in terms of total volume. One or more tundish nozzles are opened after the desired height of molten metal in the tundish is reached, thereafter the molten metal level in the tundish is maintained constant and the amount of molten metal inflow is equal to the amount of metal leaving from the tundish through the tundish nozzles to the next continuous casting equipment.

In a further aspect, the method of casting molten metal using an impact pad with a non-wavy spherical top is also designed for a mode of casting molten metal with altered properties, i.e. when in the next ladle there is a molten metal with different properties than in the previous one. In this aspect, a tundish having an impact pad with a non-wavy spherical top is emptied of molten metal having a first metal property before molten metal having a second and different metal property is poured into the tundish from the ladle. After the tundish has been emptied, a stream of molten metal having a second and different metal property is poured downwardly into the tundish and impacts the spherical top which receives the initial impact of the stream of molten metal discharged from the ladle, and upon impacting the spherical top the flow of molten metal is accelerated and optimized in terms of total volume. One or more tundish nozzles are opened after the desired height of molten metal in the tundish is reached, thereafter the molten metal level in the tundish is maintained constant and the amount of molten metal inflow is equal to the amount of metal leaving from the tundish through the tundish nozzles to the next continuous casting equipment.

Further forms, objects, features, aspects, benefits, advantages, and embodiments of the present invention will become apparent from a detailed description and drawings provided herewith.

BRIEF DESCRIPTION OF THE DRAWINGS

FIG. 1 is a schematic diagram depiction of the tundish and impact pad with spherical top of the present invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring now to drawing FIG. 1, a method of continuous molten metal casting utilizing an impact pad 11 with an upper surface having a non-wavy spherical top 12 in the tundish 10 is diagrammatically depicted which eliminates or significantly limits the disadvantages noted above. The casting method is characterized in that a stream 13 of molten metal flows downwardly from a ladle into the tundish 10. At the bottom 15 of tundish 10, located directly below the stream 13 is the impact pad 11 with the spherically shaped top surface 12. It is this surface which receives and outwardly deflects the initial impact flow of molten metal stream 13, and therefore the surface area of the spherical shape needs to be sufficiently large to encompass the entire flow diameter of the stream 13. Thereafter, the flow of molten metal from the stream 13 is accelerated and optimized in terms of total volume. One or more tundish nozzles 16 are opened after reaching the desired height of molten metal in the tundish, after which the molten metal level is maintained constant and the amount of inflow in molten metal into the tundish 10 is equal to amount of molten metal which leaves from the tundish 10 through tundish nozzles 16 to the next continuous casting equipment.

A further method of molten metal casting utilizing impact pad 11 is particularly suitable for the situation of molten metal casting with changed characteristics, in other words when there is molten metal with another quality in next ladle from what was in the previous ladle. In such situations, the tundish 10 must be emptied as much as possible, because the casting created by the mixture of the first and next ladle is unsaleable. The casting speed varies when the ladle is changing etc. and therefore the subject casting method extends the average retention time at lower and higher casting speeds. In this method, tundish 10 at the bottom 15 of which is located an impact pad 11 having a non-wavy spherical top 12 is emptied of molten metal having a first metal property before molten metal having a second and different metal property is poured into the tundish 10 from the ladle. After the tundish 10 has been emptied, a stream of molten metal having a second and different metal property is poured downwardly into the tundish 10 and impacts the non-wavy spherical top 12 which, due to its convex curvature, outwardly deflects the initial impact of the stream 13 of molten metal discharged from the ladle, and upon impacting the spherical top 12 the flow of molten metal is accelerated and optimized in terms of total volume. One or more tundish nozzles 16 are opened after the desired height of molten metal in the tundish 10 is reached, thereafter the molten metal level in the tundish 10 is maintained constant and the amount of molten metal inflow is equal to the amount of metal leaving from the tundish 10 through the tundish nozzles 16 to the next continuous casting equipment.

An advantage of this method of molten metal casting utilizing impact pad 11 with spherical top 12 is that there is eliminated the short circuit flow also at low casting speed, in the tundish 10 there is avoided the formation of dead zones, red eye effect on the surface of molten metal, and the entrainment of tundish slag into the molten metal volume is minimized. The result is signified by a positive impact on the metal purity from the point of view of a lack of inclusions. An economic loss arising out of failure to sell steel of undetermined quality arising from a not emptied tundish is eliminated by this method of casting.

The subject invention is industrially applicable in the field of metallurgy, particularly for the production of steel alloys, allowing big steel mills to meet the requirements of small amounts of alloy steel and economically efficient use of existing facilities.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A method of continuous casting metals having different metallurgical properties utilizing an impact pad having a non-wavy spherical top impact surface without any surrounding sidewalls or weirs in a tundish, comprising the steps of:

providing a tundish at the bottom of which is located an impact pad having a non-wavy spherical top impact surface without any surrounding sidewalls or weirs;

emptying the tundish of molten metal having a first metal property;

pouring a stream of molten metal having a second and different metal property downwardly into the tundish such that the stream impacts the non-wavy spherical top of the impact pad;

upon impacting the non-wavy spherical top said stream of molten metal is accelerated;

opening one or more tundish nozzles after the desired height of molten metal in the tundish is reached; and thereafter maintaining the molten metal level in the tundish constant wherein the amount of molten metal inflow is equal to the amount of metal leaving from the tundish through the tundish nozzles to a next continuous casting equipment.

2. The method of claim 1 wherein metals casted comprises steel metal alloys.

* * * * *